US005490818A

United States Patent [19]

Haber et al.

[11] Patent Number: 5,490,818

[45] Date of Patent: Feb. 13, 1996

[54] EXERCISE DEVICE WHICH SIMULATES CLIMBING A LADDER

[76] Inventors: Terry M. Haber, 25011 Castlewood, El Toro, Calif. 92630; William H. Smedley, 33285 Blanche Dr., Lake Elsinore, Calif. 92330; Clark B. Foster, 23631 Wakefield Ct., Laguna Niguel, Calif. 92677

[21] Appl. No.: 275,762

[22] Filed: Jul. 14, 1994

[51] Int. Cl.[6] ..... A63B 23/04; A63B 22/04

[52] U.S. Cl. ..... 482/52; 482/37; 482/51; 482/112

[58] Field of Search ..... 482/34, 37, 51, 482/52, 53, 45, 113, 112, 111

[56] References Cited

U.S. PATENT DOCUMENTS

| | | | |
|---|---|---|---|
| 2,079,594 | 5/1937 | Clem | 482/37 |
| 2,819,081 | 1/1958 | Touraine | 482/45 |
| 4,225,130 | 9/1980 | Zimmerman | 482/60 |
| 4,934,690 | 6/1990 | Bull | 482/113 |
| 4,958,830 | 9/1990 | Huggins et al. | 482/51 |
| 4,973,046 | 11/1990 | Maxwell | 482/60 |
| 4,982,952 | 1/1991 | Wang | 482/53 |
| 5,192,258 | 3/1993 | Keller | 482/51 |
| 5,199,932 | 4/1993 | Liao | 482/37 |
| 5,299,995 | 4/1994 | Ko | 482/52 |
| 5,336,143 | 9/1994 | Wu | 482/52 |

*Primary Examiner*—Stephen R. Crow
*Attorney, Agent, or Firm*—Hawes & Fischer

[57] ABSTRACT

An exercise device for use at home or in a gym by which a user can simulate climbing a ladder. First and second carriage tubes are slidable axially and reciprocally over respective first and second carriage guide rails that extend in spaced, parallel alignment between top and bottom frame members. The first and second carriage rails are interlinked by first and second drive cables and a series of cable pulleys so that the carriage rails move in opposite directions relative to one another in response to successive pushing and pulling forces applied by the user to hand grips and foot pedals connected to each of the carriage tubes. A hydraulic control system is provided to permit the user to selectively adjust the minimum force which must be applied to the hand grips and/or the foot pedals to cause the carriage tubes to slide along the guide rails. The hydraulic control system includes a piston that is connected to and movable with one of the carriage tubes and a hydraulic fluid valve that controls the rate at which the piston can be moved.

16 Claims, 11 Drawing Sheets

EXERCISE DEVICE WHICH SIMULATES CLIMBING A LADDER

BACKGROUND OF THE INVENTION

1. Field of the Invention

This invention relates to an exercise device for use at home or in a gym by which the user can simulate climbing a ladder.

2. Background Art

Commercially available exercise devices which simulate climbing are known to those skilled in the art. However, such conventional exercise devices are replete with many shortcomings. For example, some conventional exercise devices work on a sprocket and chain drive system which is known to generate repeated impact forces to the ankles and knees of the user. Consequently, the user may experience pain and the eventual deterioration of his knees after prolonged use of a sprocket and chain driven device. Other exercise devices include hydraulic motors to enable the user to vary the intensity of the workout. Such hydraulic motors are typically mounted at out of the way and inconvenient locations, which makes the motor hard to service as well as expensive to repair. Still other exercise devices include gripping spikes and supports to be coupled to the hands and/or feet of the user. Such spikes and supports are frequently insensitive to the user's physique and fail to adequately conform to the various gyrations of the user's body during the exercise workout which can lead to discomfort and possible injury. Yet other conventional devices include structure support bars that are located immediately in front of and close to the body of the user so as to impede the workout and/or lead to inconvenience in that the user must be on guard to avoid contact with such support bars during the exercise process.

SUMMARY OF THE INVENTION

In general terms, an exercise device is disclosed which can be used at home or in a gym to allow the user to simulate climbing a ladder and avoid the inherent shortcomings of conventional climbing exercise devices. A pair of rectangular carriage tubes are mounted for linear and reciprocal sliding movement over respective elongated, rectangular carriage guide rails at opposite sides of the exercise device. A hand grip is affixed, by means of a gimbaled connection, near the top of each carriage tube. A foot pedal is affixed, by means of a rotatable axle, near the bottom of each carriage tube. The pairs of carriage tubes are linked to one another by first and second drive cables. That is, a first drive cable extends from the top of a first of the pair of carriage tubes located at one side of the exercise device, over a pair of top cable pulleys, to the top of the second carriage tube located at the opposite side of the exercise device. A second drive cable extends from the bottom of the first carriage tube, over a pair of bottom drive pulleys, to the bottom of the second carriage tube.

Each of the pair of carriage tubes is provided with an identical upper and lower roller assembly. Each roller assembly includes a bearing block that carries a set of notched and flat rollers. In the assembled configuration, each carriage tube surrounds and is adapted to slide evenly along a respective carriage guide rail with the notched rollers of the upper and lower roller assemblies coupled to and rolling over corners of the rectangular guide rail and the flat rollers of the upper and lower roller assemblies coupled to and rolling over the flat sides of the guide rail. In this manner, successive push-pull forces generated by the user and applied to the hand grips and/or foot pedals of the carriage tubes during the simulated ladder climbing exercise will cause the pair of carriage tubes to slide in opposite directions relative to one another over respective guide rails.

The exercise device of this invention also includes a hydraulic control system which allows the user to selectively vary the minimum pushing and pulling forces that must be applied to the hand grips and/or foot pedals to cause the carriage tubes to slide over their carriage guide rails. The hydraulic control system is a closed fluid system that includes a hydraulic cylinder coupled to a hydraulic valve tube. A hydraulic valve is disposed within the hydraulic valve tube so as to be rotated by the user between fully opened and fully closed positions. A hydraulic piston is located within and movable through the hydraulic fluid within the hydraulic cylinder. The piston is carried on an elongated piston rod, one end of which is fixedly connected to and movable reciprocally with one of the pair of carriage tubes. The rate at which the piston is moved through the hydraulic cylinder and the resistance which the user must first overcome to cause the carriage tubes to slide reciprocally over their guide rails is dependent upon the position to which the hydraulic valve has been set by the user and the corresponding rate at which hydraulic fluid flows therepast.

DETAILED DESCRIPTION

Figure 1A:
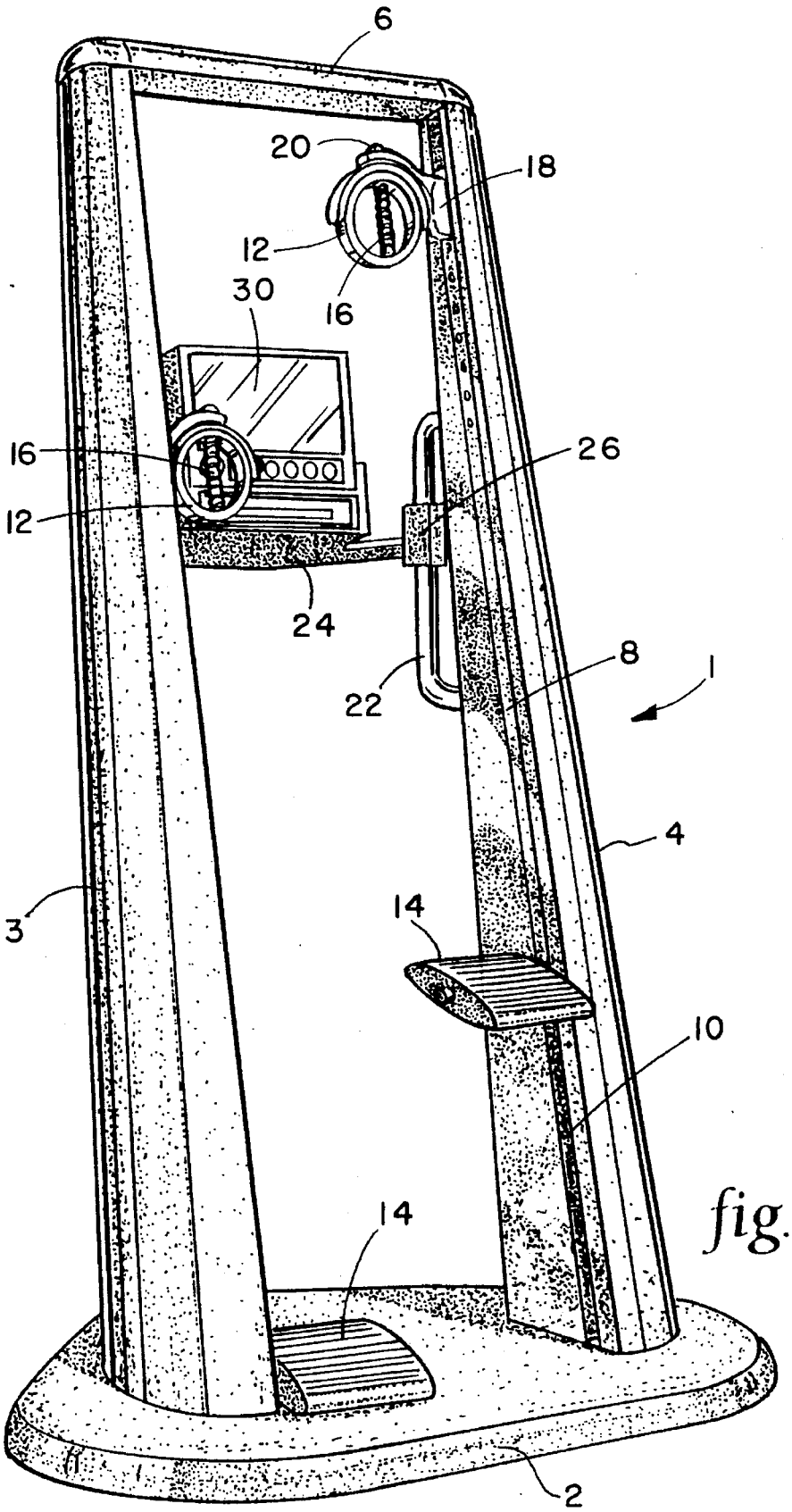
FIG. 1A is a front perspective view illustrating the exercise device which forms the present invention and allows the user to simulate climbing a ladder.
Figure 1B:
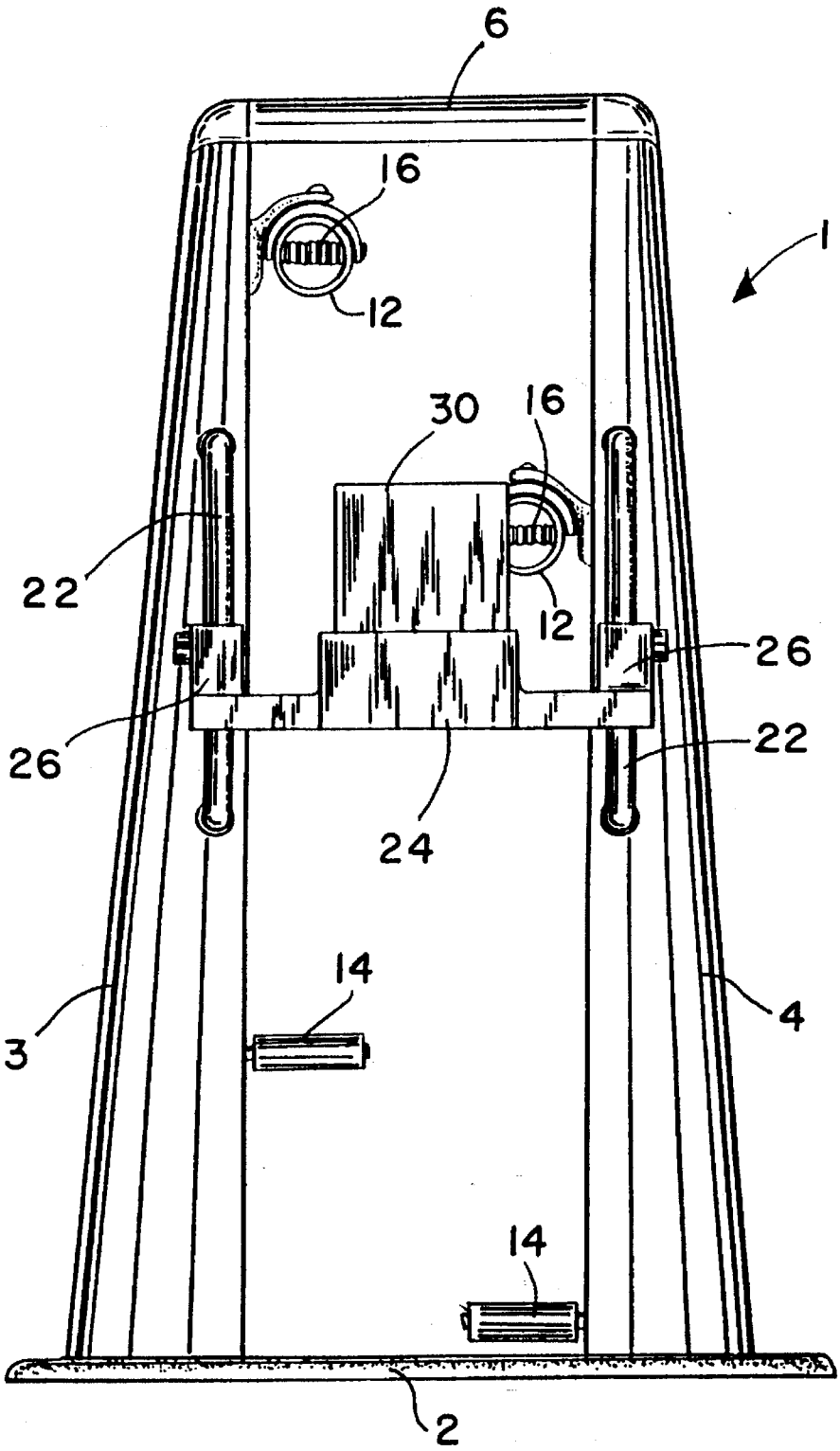
FIG. 1B is a rear view of the exercise device of FIG. 1.
Figure 1C:
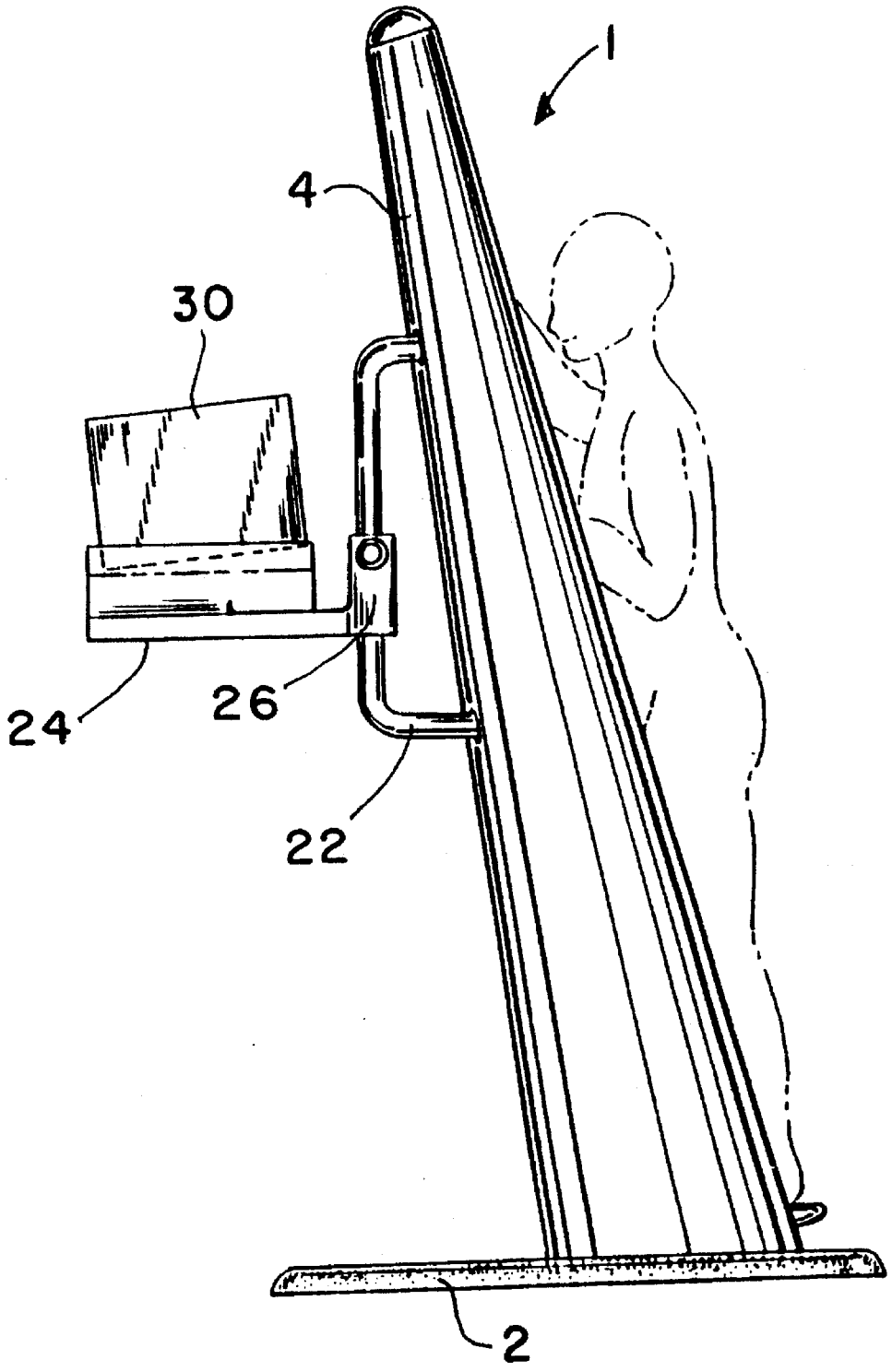
FIG. 1C is a side view of the exercise device of FIG. 1.

The exercise device 1 for use at home or in a gym that allows the user to simulate climbing a ladder and which forms the present invention is now described while referring to the drawings, where FIGS. 1A, 1B, and 1C show a generally flat base 2, a pair of parallel aligned outer side covers 3 and 4 rising upwardly from the base 2, and a top cover 6 extending laterally across the tops of side covers 3 and 4 in spaced parallel alignment with the base 2. It is to be understood that the side and top covers 3, 4, and 6, illustrated in FIGS. 1A, 1B and 1C are included for cosmetic purposes only to enhance the aesthetic appearance of exercise device 1. However, other than to support a pair of monitor mounting rails (designated 22) and to prevent user contact with the soon to be described carriage tubes 8 and drive cables 96, the side and top covers 3, 4 and 6 provide no particular function which is necessary to the understanding of this invention.

A pair of rectangular carriage tubes 8 (only one of which being partially visible in FIG. 1A) moves linearly and reciprocally through longitudinal slots 10 formed in respective side covers 3 and 4. An annular hand grip 12 is attached near the top of each carriage tube 8, and a foot pedal 14 is attached near the bottom of each carriage tube 8 so as to be movable therewith. Each hand grip 10 includes a hand bar 16 to be grasped by the user. Each hand grip 10 is rotatably connected to a mounting bracket 18 by means of a gimbaled connection 20, and the mounting bracket 18 is affixed to its carriage tube 8. By virtue of the multi-axis gimbaled connection 20, the hand bar 16 carried by the hand grip 12 may be oriented to maximize comfort and avoid injury to the wrist of the user. Similarly, each foot pedal 14 is pivotally affixed to its carriage tube 8 by a rotating axle that is carried by a pedal mounting bracket (designated 13 and best shown in FIG. 5) to permit the foot pedal to be rotated during use to accommodate the needs of the user and avoid possible injury to the ankle. Each foot pedal 14 may be provided with an optional foot strap (designated 15 and also best shown in FIG. 5) to hold the user's foot thereagainst.

As is best shown in FIG. 1B, a pair of generally U-shaped monitor rails 22 are connected to and project outwardly (i.e. rearwardly) from each of the side covers 3 and 4 of the exercise device 1. A monitor support 24 is coupled to the monitor rails 22 by cylindrical coupling sleeves 26 which are adapted to slide up and down the rails to adjust the location of the monitor support 24 depending upon the needs of the user. To this end, a tightening knob 28 (best shown in FIG. 1C) is manually operated by the user to releasably retain the coupling sleeve 26 at a desired position along the monitor rails 22.

A conventional video monitor 30 rests upon the monitor support 24 to allow the user to watch television, video cassettes and other forms of entertainment while exercising. In this regard, and as best illustrated in FIG. 1C, it may be appreciated that the video monitor 30 is spaced rearwardly from the side covers 3 and 4 of exercise device 1. Moreover, no structural support bars are located between side covers 3 and 4 and in front of the user's body to interfere with the workout or cause inconvenience to the user. Thus, the user will have unobstructed viewing of the monitor 30 while his hands and feet may easily engage hand grips 12 and foot pedals 14 so that exercising can be safe, fun and comfortable.

FIGS. 2A, 2B, 2C and 3 of the drawing illustrate the interrelationship between the pair of rectangular carriage tubes 8 with respective elongated, rectangular carriage guide rails 32 so that the tubes 8 will slide linearly and reciprocally over the guide rails 32 to enable the ladder climbing exercise to be accurately simulated by the user. The elongated carriage guide rails 32 extend vertically and in parallel alignment to one another through respective side covers 3 and 4 of the exercise device 1 between bottom and top frame members (designated 33 and 35 and best shown in FIG. 6) so as to form a structurally sound frame.

Figure 2A:
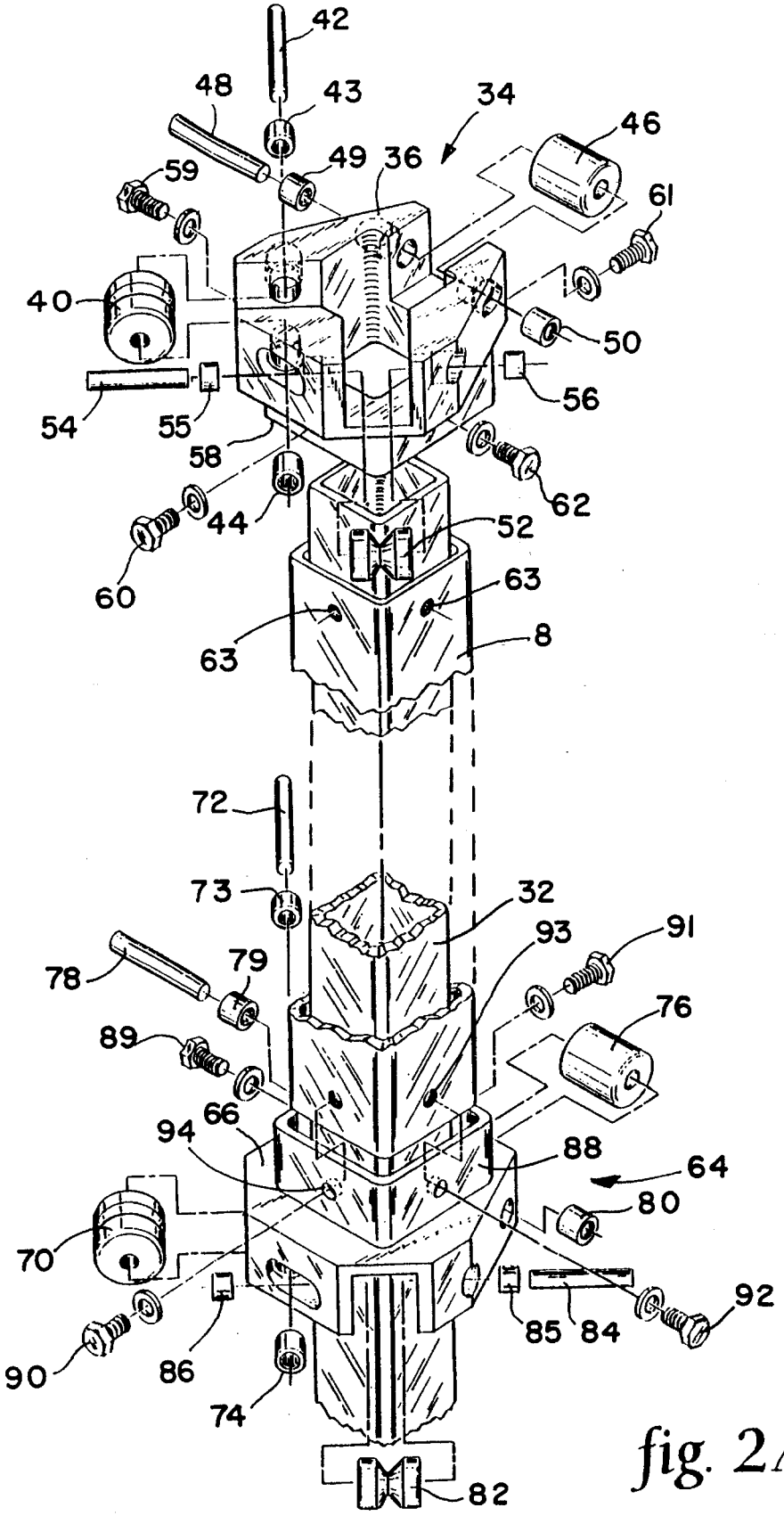
FIG. 2A is an exploded view showing identical upper and lower roller assemblies to be connected to upper and lower ends of one of a pair of carriage tubes that is slidable over a carriage guide rail.
Figure 2B:
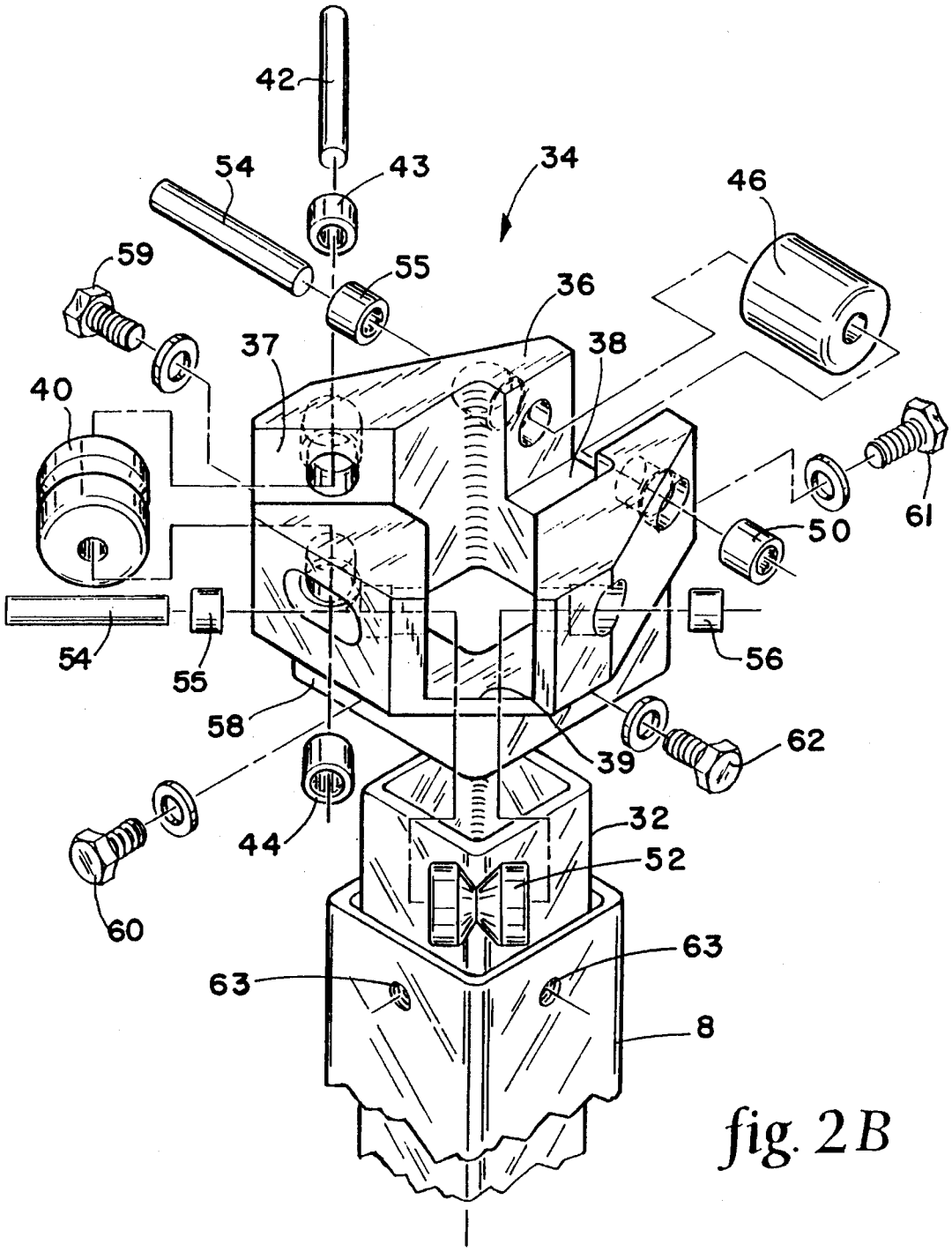
FIG. 2B is an enlarged detail showing the upper roller assembly of FIG. 2A.

Referring concurrently to FIGS. 2A and 2B, an upper roller assembly 34 is shown connected to the upper end of one of the carriage tubes 8 that is movable along a guide rail 32 at one side of the exercise device 1. However, an identical upper roller assembly 34 is similarly connected to the upper end of the carriage tube 8 at the opposite side of the exercise device 1. For purposes of convenience, only the one upper roller assembly 34 shown in FIGS. 2A and 2B will be described.

Upper roller assembly 34 includes a bearing block 36 having three generally flat faces that surround a central, rectangularly shaped passageway. A rectangular pocket 37, 38 and 39 (best shown in FIG. 2B) separates each of the faces of bearing block 36 from one another. A first notched roller 40 is rotatably supported within the first pocket 37 of bearing block 36 by means of an axle 42 and a pair of roller bearings 43 and 44. A flat roller 46 is rotatably supported within the second pocket 38 of bearing block 36 by means of an axle 48 and a pair of roller bearings 49 and 50. A second notched roller 52 is rotatably supported within the third pocket 39 of bearing block 36 by means of an axle 54 and a pair of roller bearings 55 and 56.

Depending downwardly from the bearing block 36 is a rectangular mounting flange 58. Mounting flange 58 is sized to be coupled to the upper end of the rectangular carriage tube 8. In the assembled configuration (of FIG. 3), the rectangular carriage guide rail 32 will be surrounded by carriage tube 8 so as to extend through the central passageway of the bearing block 36 of upper roller assembly 34. To this end, the mounting flange 58 of bearing block 36 is provided with a series of holes (not shown) that, in the assembled configuration, are aligned with respective threaded holes 63 formed through each side at the upper end of the carriage tube 8. A corresponding set of threaded bolts 59, 60, 61 and 62 are received through the holes (e.g. 63) through mounting flange 58 and carriage tube 8 to secure the bearing block 36 of upper roller assembly 34 to the carriage tube 8 such that carriage tube 8 is adapted for linear and reciprocal movement along the guide rail 32.

Figure 2C:
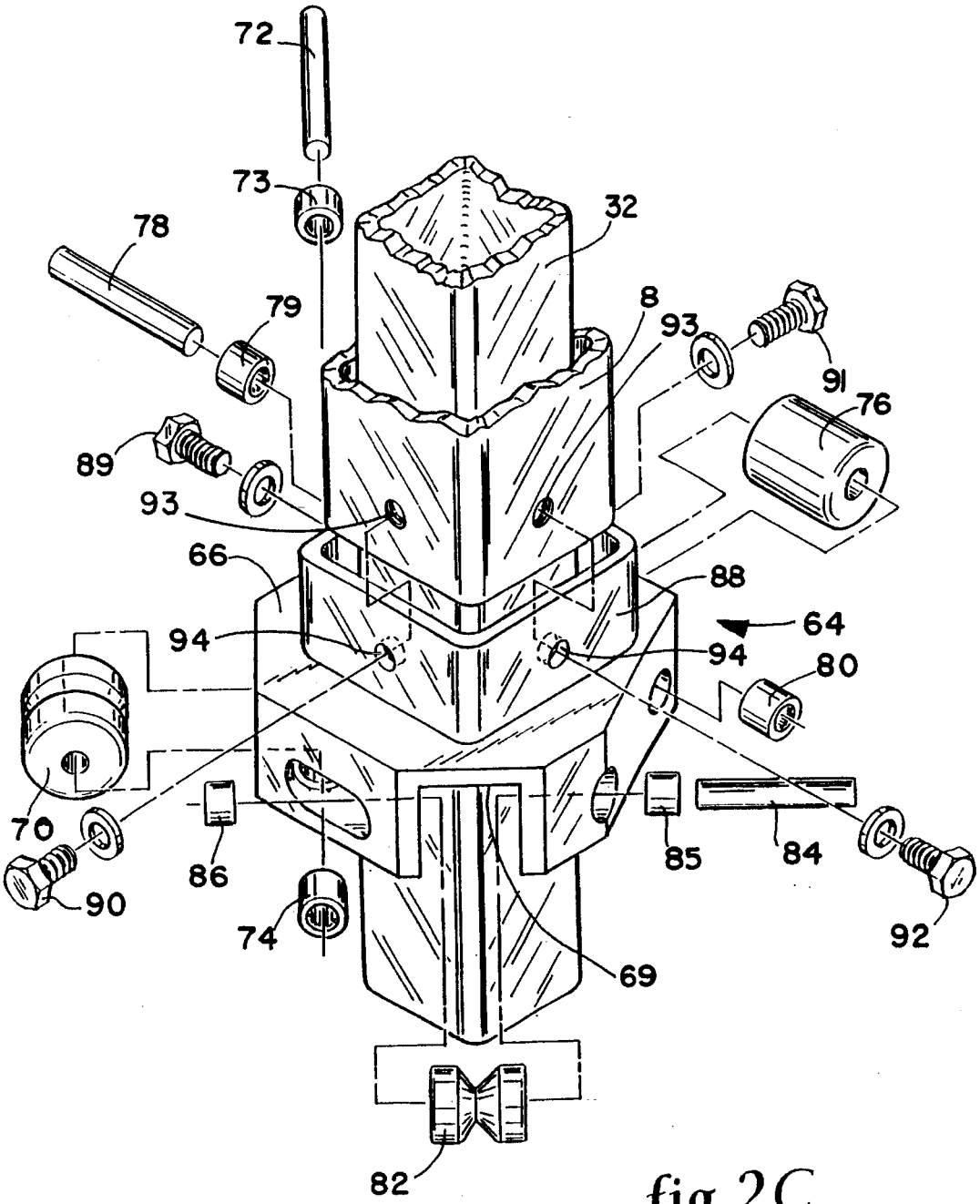
FIG. 2C is an enlarged detail showing the lower roller assembly of FIG. 2A.

Referring concurrently to FIGS. 2A and 2C of the drawings, the lower roller assembly 64 is described for one of the carriage tubes 8 at one side of the exercise device 1. As was pointed out with regard to the upper roller assembly 34, an identical lower roller assembly 64 is associated with the carriage tube 8 at the opposite side of exercise device 1. For purposes of convenience, only the one lower roller assembly 64 that is shown in FIGS. 2A and 2C will be described herein.

Lower roller assembly 64 includes a bearing block 66 having three generally flat faces that surround a generally rectangular central passageway. A rectangular pocket (only one of which 69 being shown in FIG. 2C) separates each of the faces of bearing block 66 from one another. A first notched roller 70 is rotatably supported within a first pocket of bearing block 66 by means of an axle 72 and a pair of roller bearings 73 and 74. A flat roller 76 is rotatably supported within a second pocket of bearing block 66 by means of an axle 78 and a pair of roller bearings 79 and 80. A second notched roller 82 is rotatably supported within the third pocket 69 of bearing block 66 by means of an axle 84 and a pair of roller bearings 85 and 86.

Depending upwardly from the bearing block 66 is a rectangular mounting flange 88. Mounting flange 88 is sized to be coupled to the lower end of the carriage tube 8 so that the carriage guide rail 32 will be surrounded by carriage tube 8 and extended through the central passageway of the bearing block 66 of lower roller assembly 64 (best shown in FIG. 6). To this end, the mounting flange 88 of bearing block 66 is provided with a series of holes 94 that, in the assembled relationship, are aligned with respective threaded holes 93 formed through each face at the lower end of carriage tube 8. A corresponding set of threaded bolts 89, 90, 91 and 92 are received through the holes 93 and 94 of the mounting flange 88 and carriage tube 8 to secure the bearing block 66 of lower roller assembly 64 to the carriage tube 8 such that carriage tube 8 is adapted for linear and reciprocal motion along guide rail 32.

Figure 3:
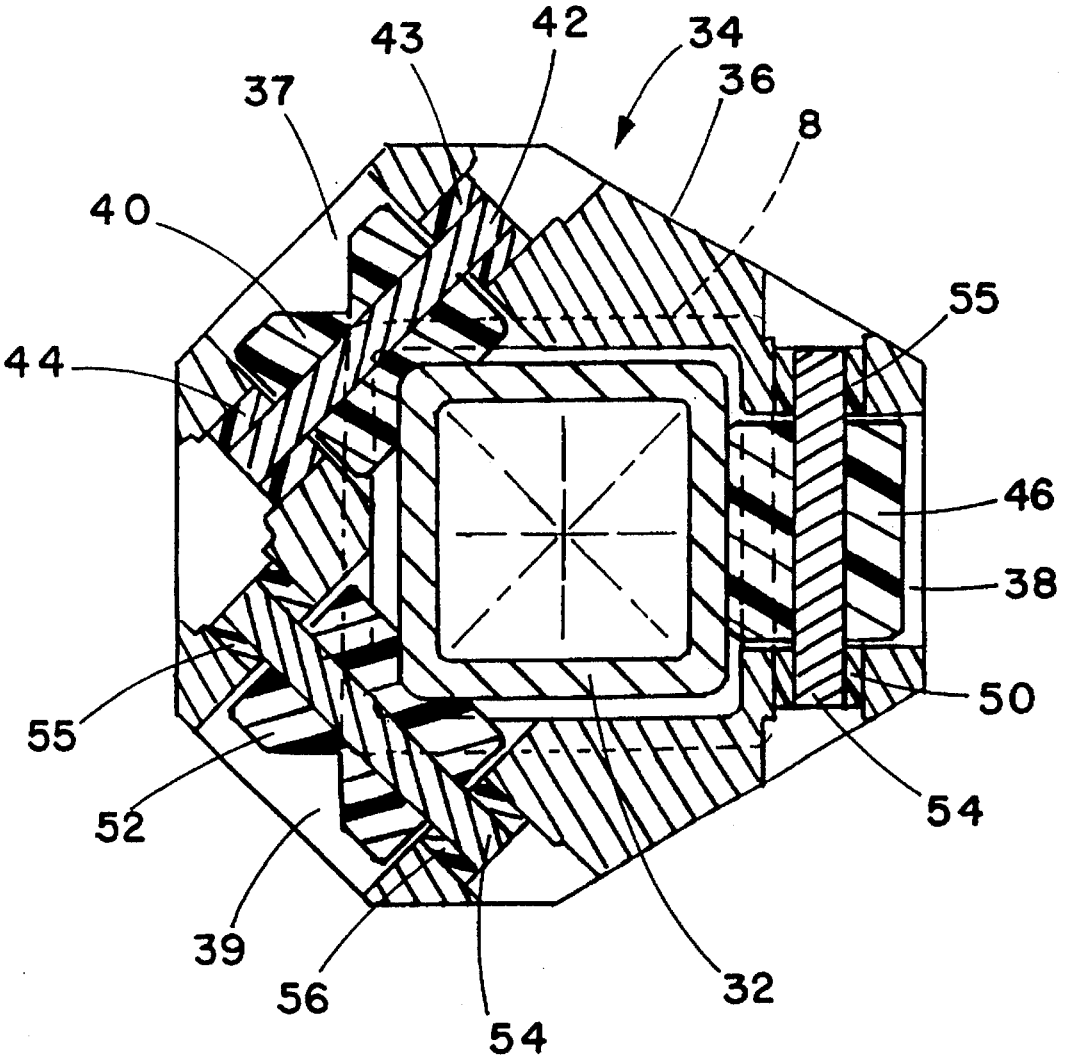
FIG. 3 is a cross-section taken through either one of the upper or lower roller assemblies of FIG. 2A with the carriage tube surrounding and sliding over the carriage guide rail.

FIG. 3 of the drawings shows the upper roller assembly 34 fixedly coupled to the upper end of a carriage tube 8 to permit carriage tube 8 to slide linearly and reciprocally along the carriage guide rail 32 at one side of the exercise device 1. However, it is to be understood that the lower roller assembly 64 is fixedly coupled to the lower end of the same carriage tube 8 in precisely the same manner as that illustrated in FIG. 3. For purposes of convenience, only the connection of the upper roller assembly 34 to carriage tube 8 will be described herein.

In the assembled configuration, the rectangular carriage guide rail 32 at one side of the exercise device 1 is surrounded by the rectangular carriage tube 8. Moreover, guide rail 32 is received through the central passageway of the bearing block 36 of upper roller assembly 34. Accordingly, the notched rollers 40 and 52 that are supported for rotation by axles 52 and 54 within pockets 37 and 39 of bearing block 66 are coupled to and ride along carriage guide rail 32 at respective corners thereof. Furthermore, the flat roller 46 that is supported for rotation by axle 54 within the pocket 38 of bearing block 66 is coupled to and rides along carriage guide rail 32 at one of the flat sides thereof. Thus, and by virtue of the upper roller assembly 34 (as well as the lower roller assembly 64 and the coupling of the rollers 40, 46 and 52 thereof to one side and two corners of the carriage guide rail 32), the carriage tube 8, to which the upper and lower roller assemblies 34 and 64 are affixed, will ride smoothly and reliably over the guide rail 32 as the user simulates a ladder climbing exercise.

Figure 4:
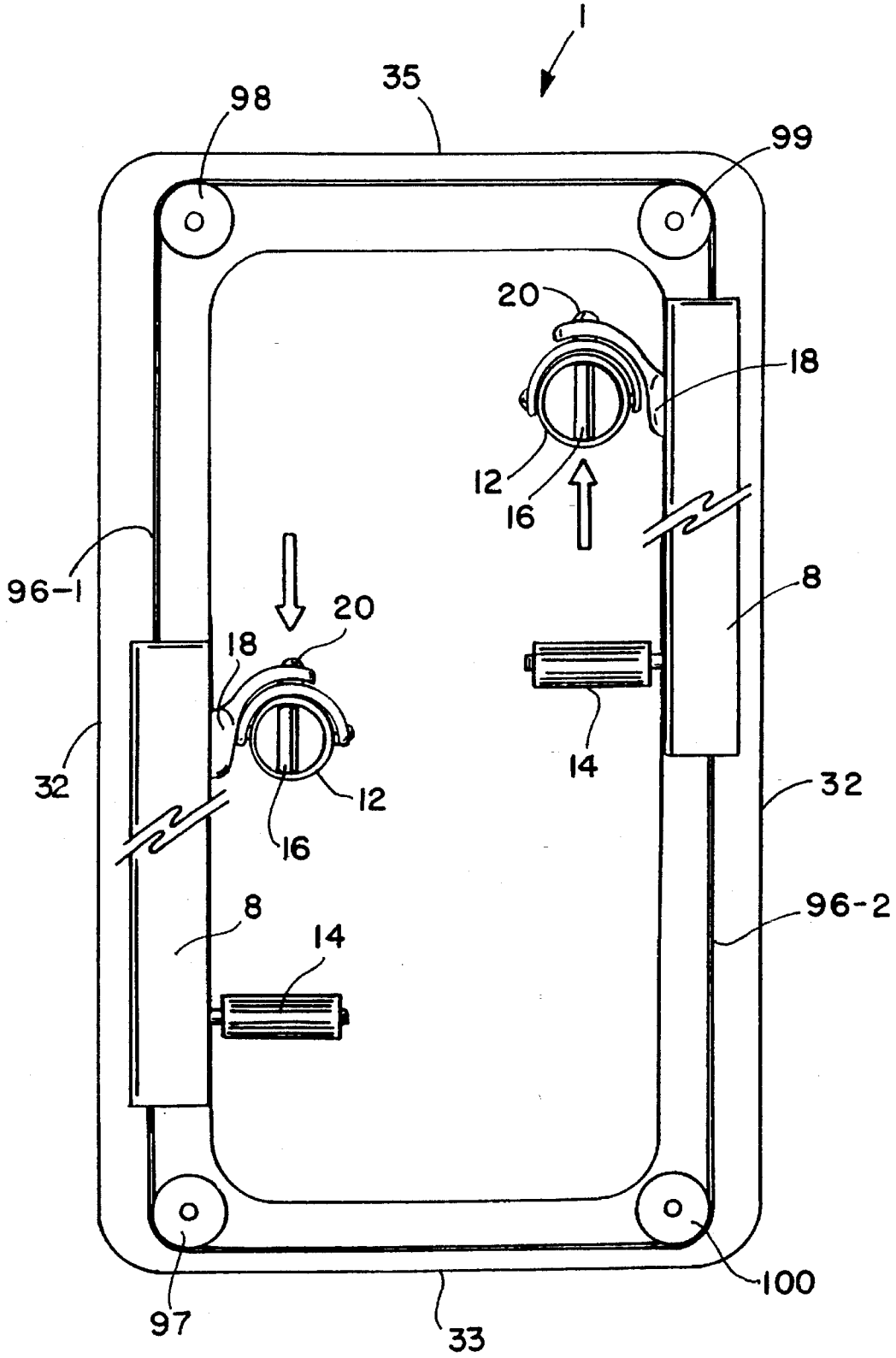
FIG. 4 is a schematic illustration of the pair of slidable carriage tubes interlinked with one another by means of first and second drive cables.
Figure 6:
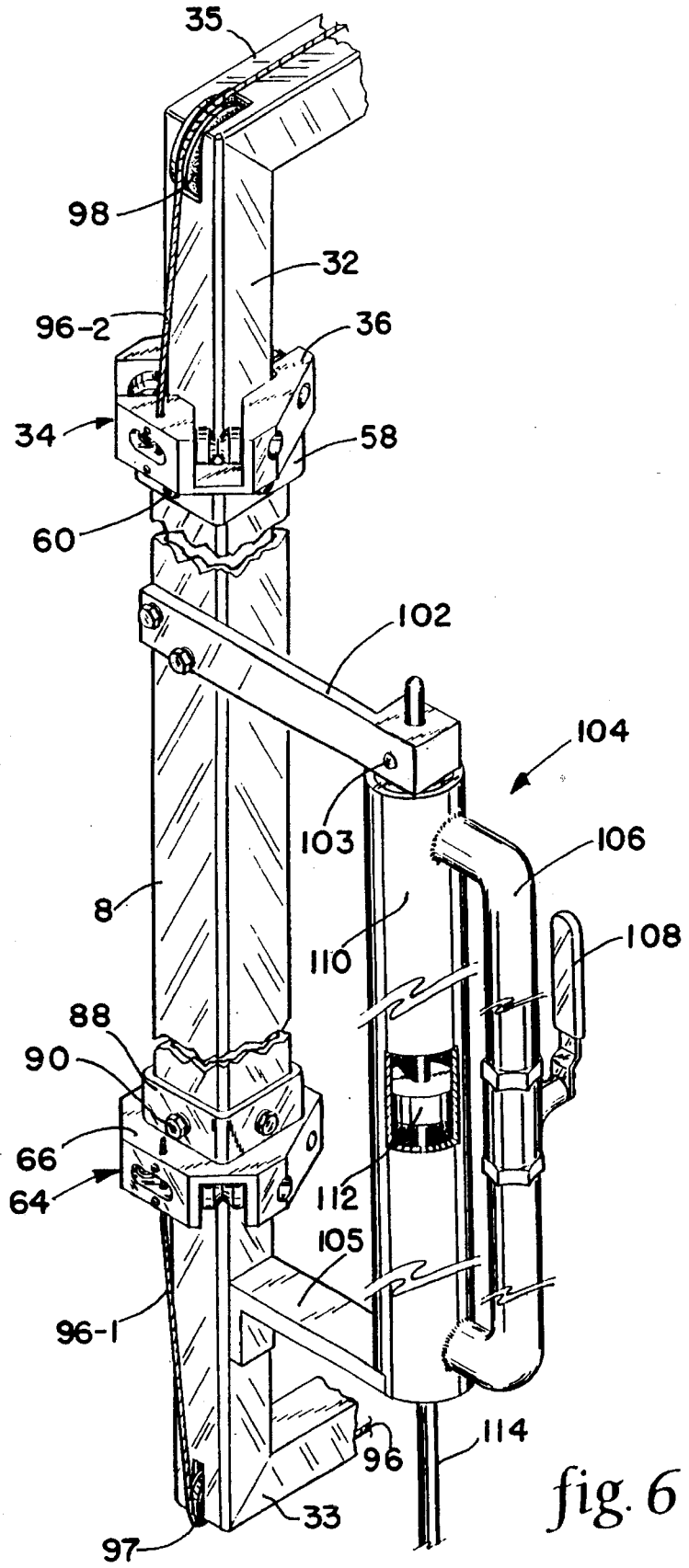
FIG. 6 illustrates a hydraulic control system which allows the user to selectively adjust the minimum force which must be generated to cause the pair of carriage tubes to slide over respective carriage guide rails.

FIG. 4 of the drawings schematically illustrates the linkage of exercise device 1 by which pushing and pulling forces applied by the user to either or both of the hand grips 12 or foot pedals 14 causes the carriage tubes 8 to slide linearly and reciprocally along respective carriage guide rails 32 at opposite sides of the device 1. More particularly, and as is also shown in FIG. 6, a cable pulley 97, 98, 99 and 100 is mounted for rotation at each corner of the exercise device 1. That is, a first cable pulley 97 is rotatably supported by a pin at the intersection of the carriage guide rail 32 at one side of the exercise device 1 with the bottom frame member 33. Similarly, a second cable pulley 98 is rotatably supported by a pin at the intersection of the carriage guide rail 32 with the top frame member 35. Third and fourth cable pulleys 99 and 100 are rotatably supported at the respective intersections of the carriage guide rail 32 at the opposite side of the exercise device 1 with the bottom and top frame members 33 and 35.

Figure 5:
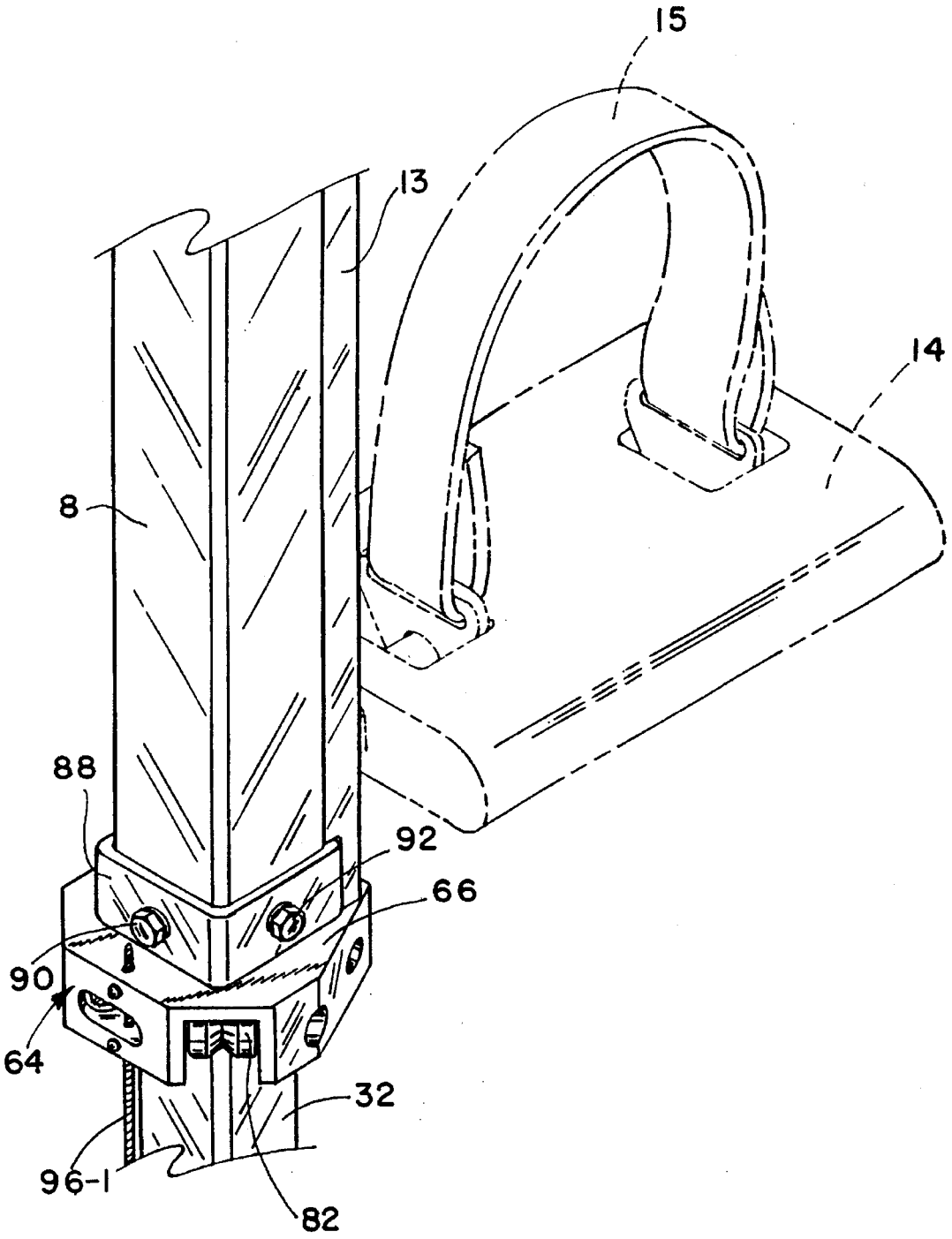
FIG. 5 is an enlarged detail showing the coupling of a foot pedal to one of the pair of slidable carriage tubes.

A first drive cable 96-1 is connected from the bottom of the carriage tube 8 at one side of the exercise device 1, around the bottom pulleys 97 and 100, to the bottom of the carriage tube 8 at the opposite side of the device. Referring briefly to FIG. 5, the opposite ends of the first drive cable 96-1 are fastened to the respective bearing blocks 66 of the lower roller assemblies 64 that are associated with the carriage tubes 8 and slide along respective carriage guide rails 32 at the opposite sides of the exercise device 1. Similarly, although not shown, the opposite ends of the second drive cable 96-2 are fastened to the respective bearing blocks 36 of the upper roller assemblies 34 that are associated with the carriage tubes 8 at opposite sides of the exercise device 1. Thus, the pair of carriage tubes 8 are interlinked with one another by means of the first and second drive cables 96-1 and 96-2. Accordingly, pushing or pulling force applied by the user to the hand grips 12 and/or foot pedals 14 which causes one of the carriage tubes 8 at one side of the exercise device 1 to slide a certain distance over its guide rail 32 in one direction will cause the other carriage tube 8 at the opposite side of the device 1 to slide the same distance but in an opposite direction over its guide rail 32.

Referring now to FIG. 6 of the drawings, a hydraulic control system 104 is shown by which the user is able to selectively vary the resistance which must be overcome by a pushing or pulling force applied to the hand grips 12 and/or foot pedals 14 to cause the pair of carriage tubes 8 to slide linearly and reciprocally over their respective guide rails 32. The hydraulic control system 104 is filled with a suitable hydraulic fluid and includes a hydraulic valve tube 106 that is connected to and communicates fluidically with a hydraulic cylinder 110 to form a closed fluid system. A hydraulic piston 112 is carried by an elongated piston rod 114. Piston 112 is movable linearly and reciprocally through the hydraulic cylinder 110 in sync with the linear and reciprocal movement of the carriage tube 8 over the carriage guide rail 32.

More particularly, one end of the hydraulic cylinder 110 is fixedly attached to the guide rail 32 by a weldment 105. The piston rod 114 projects outwardly through opposite ends of the cylinder 110. One (e.g. the top) end of rod 114 is connected to the carriage tube 8 by means of a mounting bracket 102 and a hold down screw 103 which is tightened against the piston rod 114. It may therefore be appreciated that the piston rod 114 and the piston 112 carried thereby move (along with carriage tube 8) relative to the hydraulic cylinder 110. That is, cylinder 110 is fixedly connected to guide rail 32 by weldment 105. However, the piston rod 114 is connected to carriage tube 8 by mounting bracket 102 so that a sliding movement of the carriage tube 8 over its carriage guide rail 32 is translated into a corresponding movement of the piston rod 114 and the piston 112 thereof through the hydraulic cylinder 110.

As will soon be described, a handle 104, which controls the position of a hydraulic fluid resistance valve (designated 116 and best shown in FIGS. 7 and 9), is pivotally connected through the hydraulic valve tube 106. As will also be described, the user may rotate the handle 108 to control the position of the aforementioned hydraulic valve 116 within tube 106 and thereby selectively adjust the resistance which must be overcome by the user of the exercise device 1 to push and pull the hand grips 12 and/or foot pedals 14 (of FIG. 4) so that the pair of carriage tubes 8 move linearly and reciprocally relative to one another over their respective carriage guide rails 32 as hereinabove disclosed.

Figures 7, 8, 9:
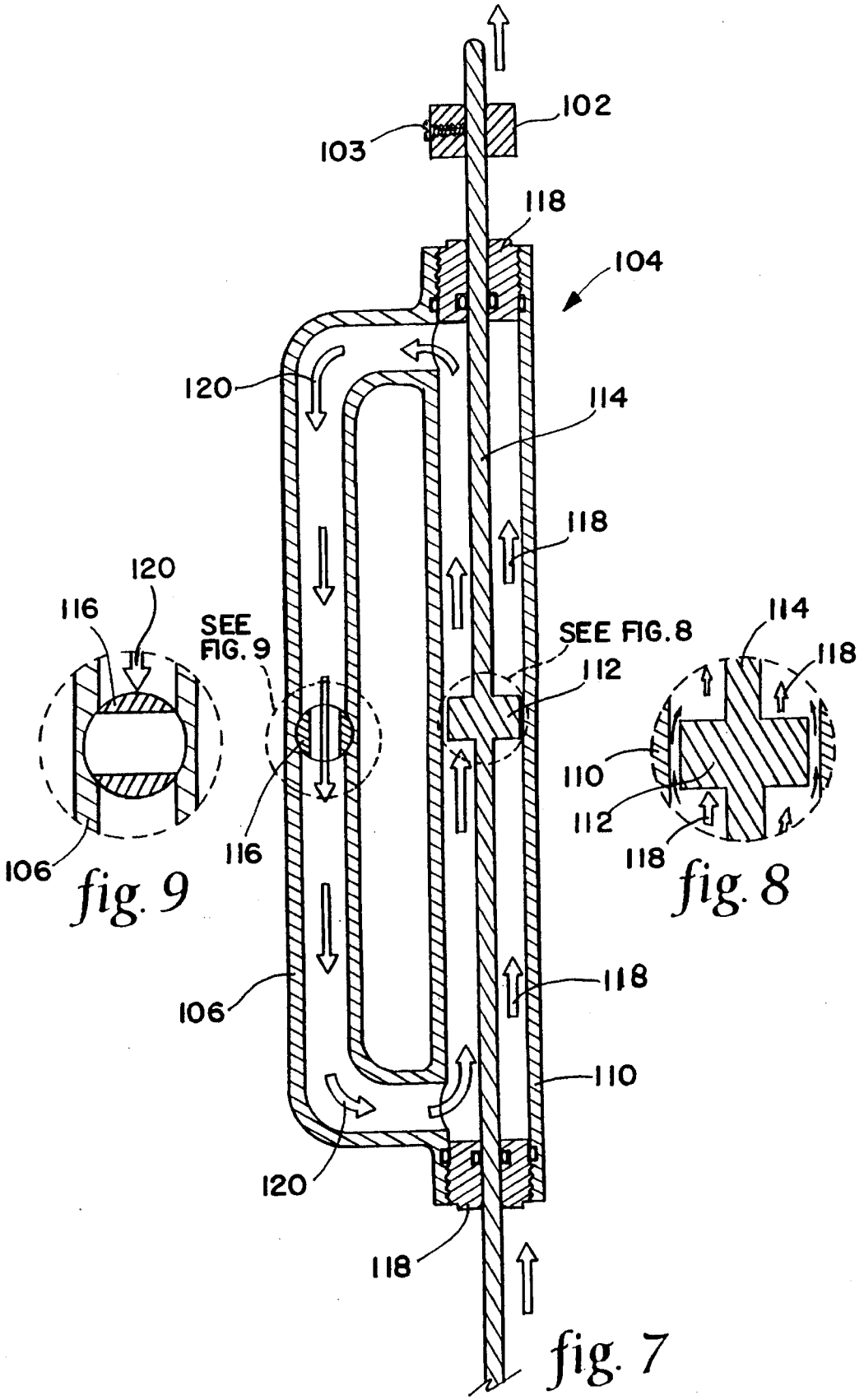
FIG. 7 is a cross-section of the hydraulic control system of FIG. 6.
FIG. 8 is an enlarged detail taken from FIG. 7 showing a hydraulic piston which forces hydraulic fluid through the hydraulic control system.
FIG. 9 is an enlarged detail taken from FIG. 7 showing a hydraulic valve which is operated by the user to control the rate at which hydraulic fluid flows through the hydraulic control system.

FIG. 7 of the drawings shows the fluid coupling of the hydraulic valve tube 106 to the hydraulic cylinder 110 to form the hydraulic control system 104 of exercise device 1. The piston rod 114 is shown extending longitudinally through and projecting outwardly from the opposite ends of hydraulic cylinder 110. The hydraulic piston, carried by piston rod 114, is movable axially and reciprocally through cylinder 110. The piston rod 114 is supported for axial movement by threaded hydraulic fluid seals 118 that are mated to correspondingly threaded openings at the opposite ends of hydraulic cylinder 114. As earlier described when referring to FIG. 6, the top end of the piston rod 114 is attached (by means of hold down screw 103) to the mounting bracket 102, and the mounting bracket 102 is fixedly connected to carriage tube 8 so that carriage tube 8 and piston rod 114 move in harmony. FIG. 7 also shows the hydraulic valve 116 supported for movement within the hydraulic valve tube 106 so as to control the rate at which hydraulic fluid flows through the hydraulic control system 104 depending upon the direction in which the fluid control valve handle 108 (of FIG. 6) is rotated.

In this regard, the operation of fluid control system 104 for selectively adjusting the resistance of the exercise device 1 is now described while referring concurrently to FIGS. 7–9 of the drawings. In FIG. 7, the hydraulic valve 116 is disposed in a fully open position within the hydraulic valve tube 106 so as to offer the minimum resistance to the flow of hydraulic fluid therepast. Being that hydraulic valve tube 106 and hydraulic cylinder 110 are coupled to one another to form a closed hydraulic fluid circuit, it will now be relatively easy for the user to cause hydraulic piston 112 to move through hydraulic cylinder 110 as the carriage tubes 8 are simultaneously moved along respective carriage guide rails 32 (of FIG. 6).

In FIGS. 7 and 8, the piston rod 114 is shown moving upwardly and in sync with a carriage tube 8 so that the hydraulic piston 112 that is carried by rod 114 is similarly moved upwards through hydraulic cylinder 110 in response to the forces applied by the user to the hand grips 12 and/or foot pedals 14. Accordingly, hydraulic fluid will be forced (in the direction of reference arrows 118 and 120) around the closed fluid circuit of hydraulic control system 104 and through the fully open hydraulic valve 116 of tube 106. The hydraulic fluid will be forced by piston 112 in an opposite direction around the circuit of fluid control system 104 and through the still open valve 116 when the piston rod 114 and piston 112 thereof move downwardly through hydraulic cylinder 110 in response to a corresponding downward movement of carriage tube 8.

FIG. 9 shows the hydraulic valve 116 rotated to a fully closed position within the hydraulic valve tube 106 so as to offer the greatest resistance to the flow of hydraulic fluid therepast. That is to say, in the fully closed position of FIG. 9, valve 116 will block the flow of fluid around the circuit of hydraulic control system 104 so as to inhibit the reciprocal movements of the piston rod 114 and the hydraulic piston 112 through hydraulic cylinder 110. Therefore, it will be appreciated that during normal use of the exercise device 1 of this invention, the hydraulic valve 116 will be rotated (by means of the fluid control valve handle 108 of FIG. 6) to a position between fully open (in FIG. 7) and fully closed (in FIG. 9) to meet the needs of the user by selectively adjusting the push and pull forces that must be generated by the user to move carriage tubes 8 along carriage guide rails 32 and, correspondingly, to drive hydraulic piston 112 through the hydraulic cylinder 110.

It will be apparent that while a preferred embodiment of the invention has been shown and described, various modifications and changes may be made without departing from the true spirit and scope of the invention. Having thus set forth the preferred embodiment, what is claimed is:

We claim:

1. An exercise device to simulate climbing, comprising:

first and second guide rails extending in spaced, parallel alignment with one another, a first carriage tube coupled to and slidable reciprocally over a first of said guide rails;

a second carriage tube coupled to and slidable reciprocally over the second of said guide rails;

a first hand grip and a first foot pedal rotatably attached to said first carriage tube and a second hand grip and a second foot pedal rotatably attached to said second carriage tube, said first and second hand grips and said first and second foot pedals applying successive pushing and pulling forces generated by a user of said exercise device to each of said first and second carriage tubes to cause said carriage tubes to slide reciprocally over respective ones of said first and second guide rails; and linking means for interconnecting said first and second carriage tubes to one another in a continuous loop path so that said carriage tubes slide in opposite directions relative to one another in response to the pushing and pulling forces generated by the user and applied by said user contact means, said linking means including at least a first cable pulley and a first drive cable, said first drive cable extending from one end of said first carriage tube, around said first cable pulley, to one end of said second carriage tube, and at least a second cable pulley and a second drive cable, said second drive cable extending from an opposite end of said first carriage tube, around said second cable pulley, to the opposite end of said second carriage tube.

2. The exercise device recited in claim 1, further comprising gimbaled connection means by which first and second hand grips are rotatably attached to said respective ones of said first and second carriage tubes.

3. The exercise device recited in claim 1, further comprising a first side cover surrounding said first carriage tube, a second side cover surrounding said second carriage tube, first and second support rails respectively connected to and projecting outwardly from said first and second side covers, and video monitor support means coupled to said first and second support rails and spaced from said first and second side covers.

4. The exercise device recited in claim 1, wherein said first carriage tube includes a first roller assembly by which said first carriage tube is coupled to and slidable reciprocally over said first guide rail, said first roller assembly having first roller means to communicate with and roll along said first guide rail.

5. The exercise device recited in claim 4, wherein said first guide rail has at least two flat sides and one corner formed therebetween, the first roller means of said first roller assembly including at least one notched roller to roll along the corner of said first guide rail and at least one flat roller to roll along one of the flat sides of said first guide rail.

6. The exercise device recited in claim 4, wherein said second carriage tube includes a second roller assembly by which said second carriage tube is coupled to and slidable reciprocally over said second guide rail, said second roller assembly having second roller means to communicate with and roll along said second guide rail.

7. The exercise device recited in claim 6, wherein said second guide rail has at least two flat sides and one corner formed therebetween, the second roller means of said second roller assembly including at least one notched roller to roll along the corner of said second guide rail and at least one flat roller to roll along one of the flat sides of said second guide rail.

8. The exercise device recited in claim 1, further comprising means by which to vary the minimum pushing and pulling forces required to be generated by the user of the exercise device to cause said first and second carriage tubes to slide over said first and second guide rails.

9. The exercise device recited in claim 8, wherein said means to vary said minimum pushing and pulling forces includes a hydraulic control system having a hydraulic cylinder filled with hydraulic fluid and a piston located within said hydraulic cylinder, said piston interconnected with said first carriage tube so as to move reciprocally through said hydraulic cylinder and force said hydraulic fluid to move therethrough in response to said first carriage tube moving reciprocally over said first guide rail.

10. The exercise device recited in claim 9, said hydraulic control system also having an elongated piston rod extending through said hydraulic cylinder and supporting said hydraulic piston for reciprocal movement within said cylinder, at least one end of said piston rod projecting outwardly from said hydraulic cylinder and fixedly connected to said first carriage tube, and means by which to fixedly connect said hydraulic cylinder to said first guide rail.

11. The exercise device recited in claim 9, said hydraulic control system also having a hydraulic valve tube coupled fluidically to said hydraulic cylinder and a hydraulic valve located within said valve tube and movable between fully opened and fully closed valve positions to control the rate at which hydraulic fluid moves through said hydraulic cylinder depending upon the position of said valve.

12. The exercise device recited in claim 11, said hydraulic control system also having a rotatable valve handle connected to said hydraulic valve, such that a rotation of said valve handle causes a corresponding movement of said hydraulic valve within said hydraulic valve tube so as to change the position of said valve between said fully opened and fully closed valve positions.

13. An exercise device to simulate climbing, comprising:

first and second guide rails extending in spaced, parallel alignment with one another, a first carrier slidable reciprocally relative to a first of said guide rails;

a second carrier slidable reciprocally relative to the second of said guide rails;

user contact means by which to apply successive pushing and pulling forces generated by a user of said exercise device to each of said first and second carriers to cause said carriers to slide reciprocally relative to respective ones of said first and second guide rails; and means by which to vary the minimum pushing and pulling forces required to be generated by the user of the exercise device to cause said first and second carriers to slide relative to said first and second guide rails, said means to vary said minimum pushing and pulling forces including a hydraulic control system having a hydraulic cylinder filled with hydraulic fluid, a piston located within said hydraulic cylinder, a hydraulic valve tube coupled fluidically to said hydraulic cylinder, and a hydraulic valve located within said valve tube and being moved manually between fully opened and fully closed valve positions to enable the user to selectively control the rate at which hydraulic fluid moves through said hydraulic cylinder depending upon the position of said hydraulic valve, said piston interconnected with said first carrier so as to move reciprocally through said hydraulic cylinder and force said hydraulic fluid to move through said hydraulic valve tube in response to said first carrier moving reciprocally relative to said first guide rail.

14. The exercise device recited in claim 13, said hydraulic control system also having an elongated piston rod extending through said hydraulic cylinder and supporting said hydraulic piston for reciprocal movement within said cylinder, at least one end of said piston rod projecting outwardly from said hydraulic cylinder and fixedly connected to said first carrier, and means by which to fixedly connect said hydraulic cylinder to said first guide rail.

15. The exercise device recited in claim 13, said hydraulic control system also having a rotatable valve handle connected to said hydraulic valve, such that a rotation of said valve handle causes a corresponding movement of said hydraulic valve within said hydraulic valve tube so as to change the position of said valve between said fully opened and fully closed valve positions.

16. An exercise device to simulate climbing, comprising:

first and second guide rails extending in spaced, parallel alignment with one another, a first carriage tube coupled to a first of said guide rails and slidable reciprocally thereover;

a second carriage tube coupled to the second of said guide rails and slidable reciprocally thereover;

user contact means by which to apply successive pushing and pulling forces generated by a user of said exercise device to each of said first and second carriage tubes to cause said carriage tubes to slide reciprocally over respective ones of said first and second guide rails;

a first roller assembly connected to said first carriage tube by which said first carriage tube is slidable reciprocally over said first guide rail, said first roller assembly having first roller means to communicate with and roll along said first guide rail, and a second roller assembly connected to said second carriage tube by which said second carriage tube is slidable reciprocally over said second guide rail, said second roller assembly having second roller means to communicate with and roll along said second guide rail, said first guide rail having at least two flat sides and one corner formed therebetween, the first roller means of said first roller assembly including at least one notched roller to roll along the corner of said first guide rail and at least one flat roller to roll along one of the flat sides of said first guide rail, and said second guide rail having at least two flat sides and one corner formed therebetween, the second roller means of said second roller assembly including at least one notched roller to roll along the corner of said second guide rail and at least one flat roller to roll along one of the flat sides of said second guide rail.

* * * * *